US005978992A

United States Patent [19]

Antinori

[11] Patent Number: 5,978,992

[45] **Date of Patent: *Nov. 9, 1999**

[54] MATTRESS RETENTION BRACKET FOR ADJUSTABLE BEDS

[76] Inventor: Santino Antinori, 3615 E. Lake Ave., Tampa, Fla. 33610

[ * ] Notice: This patent is subject to a terminal disclaimer.

[21] Appl. No.: 08/822,393

[22] Filed: Mar. 20, 1997

Related U.S. Application Data

[63] Continuation of application No. 08/387,578, Feb. 13, 1995.

[51] Int. Cl.[6] ..... A47C 31/00

[52] U.S. Cl. ..... 5/658; 5/193; 5/411

[58] Field of Search ..... 5/411, 658, 617, 5/507.1, 503.1, 662, 663, 193; 248/309.1, 300

[56] References Cited

U.S. PATENT DOCUMENTS

| | | | |
|---|---|---|---|
| 2,593,567 | 4/1952 | Keck | 5/503.1 |
| 5,121,516 | 6/1992 | Jones | 5/658 |
| 5,195,200 | 3/1993 | Leoutsakos | 5/662 |

*Primary Examiner*—Michael F. Trettel
*Assistant Examiner*—Fredrick Conley
*Attorney, Agent, or Firm*—Diller, Ramik & Wight.PC

[57] ABSTRACT

The invention is directed to a mattress retention bracket for an adjustable bed to prevent an associated mattress from sliding laterally thereon. The mattress retention bracket in a preferred embodiment of the invention is a generally U-shaped member defined by a bight portion and a pair of legs with each leg having first and second end portions normally offset from each other. Terminal ends of the legs are secured to an underside of a mattress supporting member and first end portions and a bight portion of the U-shaped member lie contiguous peripheral edges of the mattress supporting member and the mattress to prevent relative shifting therebetween as a user/patient ingresses or egresses the bed. In lieu of the latter, another mattress retention bracket is substantially of a T-shaped configuration defined by an arm and a depending leg with the leg having first and second end portions defining an angle generally normal therebetween. The T-shaped mattress retention bracket is secured to an associated mattress supporting member, such that the arm and an adjacent first leg portion of the leg are contiguous a peripheral edge of the mattress and the mattress supporting member to prevent relative shifting therebetween.

4 Claims, 1 Drawing Sheet

HSm
HSf
14
12
11
10
15
13
P
M
W
A
PEm
PEs
F
S
B
FSm
FSf
W

HSm
HSf
10
11
B
LS
US
14
15
M
PEm
12
22
13
17
16
PEs
22
S 10
14
11
12
20
15
16
17
13
20

35
31
33
30
36
34
32
38
37

MATTRESS RETENTION BRACKET FOR ADJUSTABLE BEDS

This application is a continuation of application Ser. No. 08/387,578, filed Feb. 13, 1995, (pending).

BACKGROUND OF THE INVENTION

The invention relates to a retention bracket for maintaining or retaining a mattress accurately located upon its associated supporting surface, and the mattress retention bracket is more specifically constructed for use in association with an adjustable bed.

Typical mattress holders or brackets are disclosed in U.S. Pat. No. 1,125,277 granted on Jan. 19, 1915 to Homer Eckerson and U.S. Pat. No. 1,371,098 granted on Mar. 8, 1921 to Mariana T. Jones. In each of these patents a bed frame includes a set of supporting springs upon which rests a mattress, and mattress holders or brackets are attached to head ends and foot board ends of the bed frame to permit the mattress to shift relative to the frame and the springs supported thereby.

U.S. Pat. No. 4,297,754 granted on Nov. 3, 1981 to Julio A. Zuniga and U.S. Pat. No. 4,017,919 granted on Apr. 19, 1977 to John H. Hemmeter each disclose a plurality of mattress retention brackets associated with a bed, and in each of these the mattress is supported upon box springs and the mattress retention brackets prevent each mattress from shifting relative to its associated box spring.

U.S. Pat. No. 1,842,873 granted on Jan. 26, 1932 to Mary E. Leeking discloses an adjustable bed formed by a head spring section, a foldable foot spring section and an intermediate foldable spring section therebetween with the three sections supporting a mattress and several sections being adjusted to accommodate a patient in prone, sitting or partially sitting positions. Rather than utilizing retention brackets, the mattress is held to the head, intermediate and foot spring sections by a number of flexible straps having hooks at opposite ends which are selectively hooked to the spring sections and to eyelets or eye members of the mattress.

SUMMARY OF THE INVENTION

In keeping with the foregoing, the novel mattress retention brackets of the present invention are designed specifically for an adjustable bed and are of extremely simple construction, can be readily secured to and removed from the adjustable bed, assure that the mattress does not shift relative to the underlying mattress supporting member during adjustment of the bed or during a person's ingress or egress relative to the bed, and preclude injury to the user during such ingress or egress.

In a preferred embodiment of the invention, the mattress retention bracket comprises a substantially U-shaped member defined by a bight portion and a pair of legs with the latter being in generally spaced parallel relationship to each other, each leg having a first leg portion adjacent the bight portion and a second leg portion remote therefrom, the first and second leg portions of each leg being disposed substantially normal to each other, and means for securing each second leg portion to an associated adjustable bed, preferably to a mattress supporting member thereof.

In further accordance with the invention, another mattress retention bracket for an adjustable bed comprises a substantially T-shaped member defined by an arm and a leg disposed substantially normal thereto, the leg being secured to the bed, and the arm being located to prevent the mattress from shifting relative to an underlying mattress supporting member.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figures 1, 2, 3, 4:
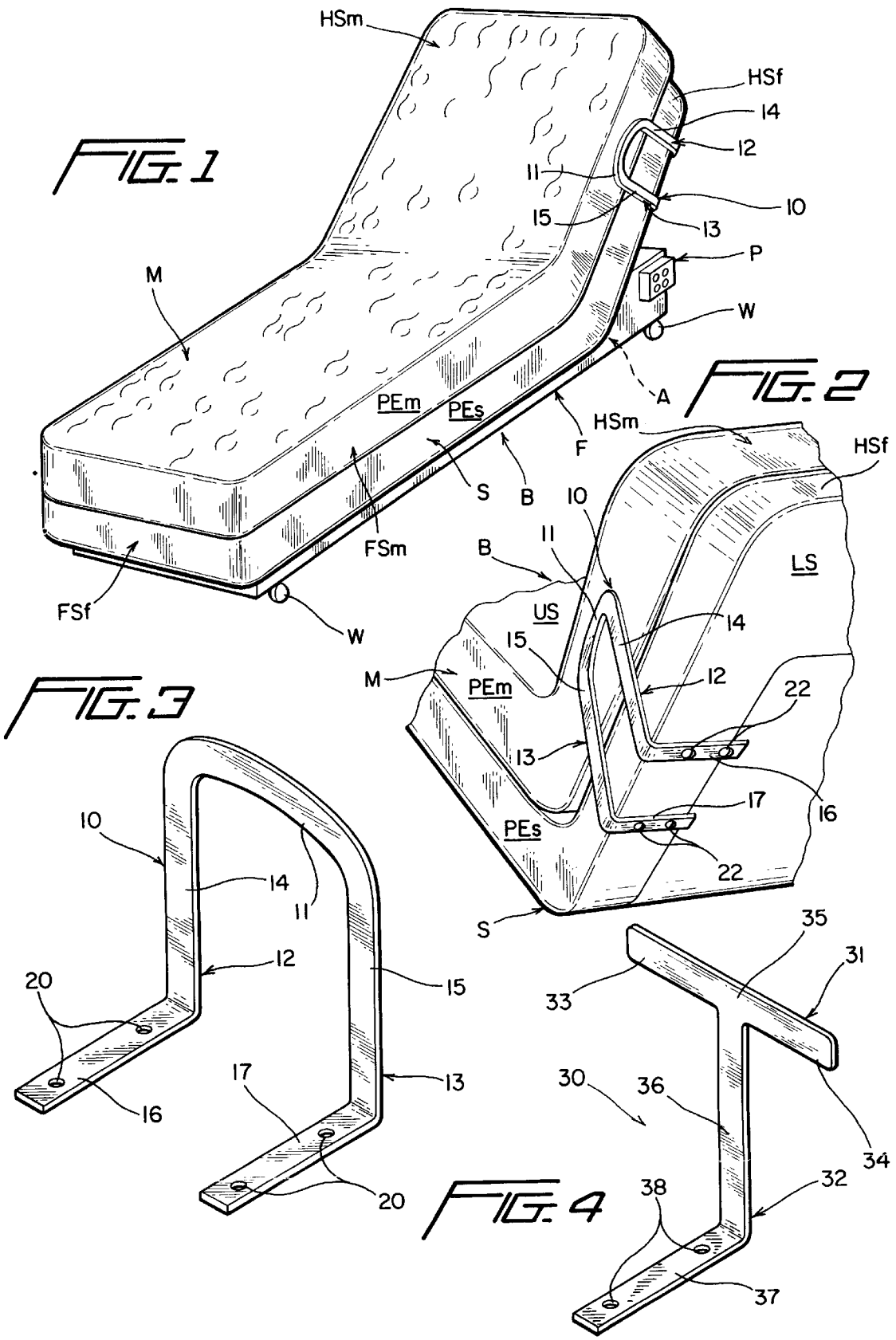
FIG. 1 is a perspective view of an adjustable bed, and illustrates a frame, the frame carrying a mattress supporting member, a mattress upon the mattress supporting member, and one of a plurality of mattress retention brackets secured to the mattress supporting member for preventing the mattress from shifting during adjustment of the bed and/or ingress and egress of a user/patient relative thereto.
FIG. 2 is an enlarged fragmentary perspective view looking from the rear of the adjustable bed of FIG. 1, and illustrates details of the mattress retention bracket and the manner in which the same is secured to the mattress supporting member.
FIG. 3 is a perspective view of the mattress retention bracket of the present invention, and illustrates the substantially inverted U-shaped configuration thereof.
FIG. 4 is a perspective view of another mattress retention bracket of the invention, and illustrates the substantially T-shaped configuration thereof.

An adjustable bed B includes a conventional frame F, wheels W, a mattress supporting member S, a mattress M and an adjusting mechanism A which includes a control panel P and suitable linkages and motors (not shown) for moving the mattress supporting member S between numerous positions of adjustment, as shown in FIGS. 1 and 2 in which head sections HSm and HSf and foot sections FSm and FSf of the respective mattress M and the mattress supporting member S are generally angulated relative to each other in a generally upright sitting position. A major problem with conventional adjustable beds, such as the bed B, particularly when in the illustrated in upright sitting position, is that the mattress M shifts or slides to one side or the other, and at times end to end, when a user/patient ingresses or egresses the bed B. Normally a peripheral edge or peripheral edge section PEm of the mattress M is in vertical alignment with a like sized peripheral edge or peripheral edge section PEs of the mattress supporting member S. However, the lateral alignment is disrupted most often during the patient entering and exiting the bed B, and the more a user gets in and out of the bed B, the worse the mattress M slides out of its aligned position with the mattress supporting member S.

In accordance with the present invention, a novel mattress retention bracket is provided for association with the adjustable bed B, and is generally designated by the reference numeral 10 (See FIGS. 1 through 3).

The mattress retention bracket 10 comprises a substantially U-shaped member defined by a bight portion 11 and a pair of legs 12, 13. Each leg 12, 13 is defined by respective first leg portions 14, 15 adjacent the bight portion 11 and second leg portions 16, 17, respectively, remote from the bight portion 11. The first leg portions 14, 15 are disposed substantially normal to the respective second leg portions 16, 17 thereof. Means 20, 21 in the form of openings are provided in the second leg portion 16, 17, respectively, for the receipt of fasteners 22, such as screws and bolts, for securing each second leg portion to the adjustable bed B, specifically to the mattress supporting member S thereof, as is best illustrated in FIG. 2. In FIG. 2 the conventional screws or fasteners 22 pass through the openings 20, 21 and are threaded into a lower surface LS of the mattress supporting member S, such that the first leg portions 14, 15 are in intimate engagement with peripheral edges PEm and PEs of the respective mattress M and mattress supporting member S, while the bight portion 11 is in intimate contact with the peripheral edge portion PEm of the mattress M. In addition, the bight portion 11 is located below an upper supporting surface US of the mattress M which assures that no matter where the mattress retention bracket 10 is located, the bight portion 11 cannot be contacted by the user/patient when ingressing or egressing the bed B and injury to the patient is thereby precluded.

The U-shaped member defining the mattress retention bracket 10 is also preferable constructed from relatively flat metallic material, although the same can be constructed from strong synthetic polymeric or copolymeric plastic material.

Though only a single mattress retention bracket 10 is illustrated in FIGS. 1 and 2 of the drawings, it is to be understood that another identical mattress retention bracket is secured to the head section HSf of the mattress supporting member S on the side opposite the mattress retention bracket 10. Furthermore, additional mattress retention brackets corresponding to the mattress retention bracket 10 can be secured to the opposite sides (unnumbered) of the foot section FSf of the mattress supporting member S. In such a case there would be two mattress retention brackets along each longitudinal side (unnumbered) at the bed B which would assure against mattress shifting in a lateral direction no matter from what side a patient/user enters or exits the bed B. Additionally, one of the mattress retention brackets 10 can be provided at the foot board end (unnumbered) of the bed B to prevent longitudinal sliding of the mattress M.

Another mattress retention bracket constructed in accordance with this invention for utilization with an adjustable bed to prevent an associated mattress from sliding thereupon is shown in FIG. 4 of the drawing and is generally designated by the reference numeral 30.

The mattress retention bracket 30 comprises a substantially T-shaped member defined by an arm 31 having opposite arm end portions 33, 34 and a medial arm portion 35 therebetween, as well as a leg 32 defined by a first leg portion 36 immediately adjacent to and secured to the medial portion 35 of the arm 31 and a second end portion 37 remote therefrom and substantially named thereto. Means in the forms of openings 38 are provided in the second leg portion 37 for securing a mattress retention bracket 30 to the mattress supporting member S in the same manner as that heretofore described relative to the mattress retention bracket 10, namely, by utilizing fasteners or screws, such as the screws 22 shown in FIG. 2. When one or more of the T-shaped mattress retention brackets 30 are secured to the mattress supporting member S in lieu of the mattress retention bracket(s) 10, the first leg portion 36 and the arm 31 are contiguous the peripheral edges PEm and PEs of the mattress M and the mattress supporting member S, respectively. Furthermore, the arm 31 of the retention bracket 30 also lies beneath the upper surface US of the mattress M to prevent user/patient injury during ingress and egress relative to the bed B.

As in the case of the generally inverted U-shaped retention bracket 10, the mattress retention bracket 30 is preferably constructed from flat metal material with the leg portions 36, 37 bent to define an angle of substantially 90° therebetween. Furthermore, though metal is the material of choice, the mattress retention bracket 30 can instead be constructed from synthetic copolymeric/polymeric plastic material.

Although a preferred embodiment of the invention has been specifically illustrated and described herein, it is to be understood that minor variations may be made in the apparatus without departing from the spirit and scope of the invention, as defined the appended claims.

What is claimed is:

1. An adjustable bed comprising a frame, said frame carrying a mattress supporting member; said mattress supporting member being defined by a foot section, a head section and a peripheral edge section; said foot section and head section being relatively movable between a first position in which said foot and head sections are substantially relatively co-planar and a second position in which said foot and head sections are substantially relatively angulated, a mattress, said mattress being defined by a foot section, a head section, an upper supporting surface and a peripheral edge section; said mattress being supported upon said mattress supporting member in head section-to-head section and foot section-to-foot section relationship and in substantially peripheral alignment, at least one means for preventing excessive undesired sliding movement of said mattress relative to said mattress supporting member incident to user ingress and egress thereby effecting substantially precise mattress retention upon said mattress supporting member, said at least one mattress sliding preventing means including a mattress retention bracket having first and second opposite end portions remote from each other, means for securing said second end portion to said mattress supporting member with said first end portion being contiguous adjacent portions of said mattress and mattress supporting member periphery edge sections to thereby prevent sliding movement therebetween, and a terminal edge of said first end portion being disposed immediately adjacent but below said mattress upper supporting surface to prevent user injury incident to user ingress and egress.

2. The adjustable bed as defined in claim 1 wherein said first and second end portions are disposed substantially normal to each other, said mattress supporting member includes a lower surface, and said securing means secure said second end portion to said mattress supporting member lower surface.

3. The adjustable bed as defined in claim 2 wherein said securing means includes at least one opening in said second end portion.

4. The adjustable bed as defined in claim 2 wherein said mattress retention bracket is formed of relative flat material.

* * * * *